US006802142B1

(12) United States Patent
Pastorello

(10) Patent No.: US 6,802,142 B1
(45) Date of Patent: Oct. 12, 2004

(54) VISCOELASTIC FLUID DISPLAY

(76) Inventor: John Pastorello, 2572-C E. Fender Ave., Fullerton, CA (US) 92631

( * ) Notice: Subject to any disclaimer, the term of this patent is extended or adjusted under 35 U.S.C. 154(b) by 0 days.

(21) Appl. No.: 10/303,177

(22) Filed: Nov. 25, 2002

(51) Int. Cl.[7] ..... G09F 19/00
(52) U.S. Cl. ..... 40/409; 40/430
(58) Field of Search ..... 40/409, 411, 414, 40/430; 446/267

(56) References Cited

U.S. PATENT DOCUMENTS 5,706,594 A * 1/1998 Lin ..... 40/406
6,006,461 A 12/1999 Snyder ..... 40/426
6,349,492 B1 * 2/2002 Lee ..... 40/426
6,594,929 B2 * 7/2003 Butcher ..... 40/406

* cited by examiner

*Primary Examiner*—S. Joseph Morano
*Assistant Examiner*—Robert J. McCarry, Jr.
(74) *Attorney, Agent, or Firm*—Edgar W. Averill, Jr.

(57) ABSTRACT

A display device which provides an entertaining and relaxing visual display while showing the formation of a stretched and moved sheet of a viscoelastic solution. A viscoelastic solution is contained in the bottom chamber of a container and a drawing element is slowly moved into and out of the viscoelastic solution. The drawing element is held above the surface of the viscoelastic solution and a portion of viscoelastic solution which has been drawn up with a drawing element falls slowly off of the drawing element to provide an entertaining and interesting display. Preferably, the drawing element has a horizontal bar which is slowly rotated into and out of the viscoelastic solution providing an ever-changing display.

14 Claims, 1 Drawing Sheet

VISCOELASTIC FLUID DISPLAY

BACKGROUND OF THE INVENTION

The field of the invention is visually entertaining devices which are, in effect, a moving art form. Such art forms in the past have included devices which blow bubbles, lava lamps, or electric arcing arrays. Such devices provide an ever-changing visual display which is pleasing to the human senses.

BRIEF SUMMARY OF THE INVENTION

It is an object of the present invention to provide a device which creates an ever-moving sheet of a viscoelastic substance which is interesting and relaxing to observe.

The present invention is for a display device showing the formation of a stretched and moved sheet of a viscoelastic solution. The device has a bottom chamber capable of containing a volume of a viscoelastic solution. A solid drawing element is moved from a position above the upper surface of the viscoelastic solution to a position wherein at least a portion of the solid drawing element enters the upper surface and volume of the viscoelastic solution. It is then slowly withdrawn from the viscoelastic solution to a position above the solution. A portion of that solution which is drawn up with the drawing element slowly falls off the drawing element and back into the solution forming a sheet or other interesting pattern as it falls slowly back into the solution.

DESCRIPTION OF THE PREFERRED EMBODIMENTS

Certain viscous liquids have a high degree of elasticity. Such liquids are capable of being elongated several feet before breaking. While such fluids can be either an aqueous or organic solution, they typically are a solution of a high molecular weight polymer.

Polymers useful with the present invention include, but are not limited to, those derived from cellulose, acrylic, alginate ethylene, propylene, butylene, vinyl, latex, lipids, carbohydrates and proteins. Preferred polymers are made from monomers of ethylene, propylene, butylene, vinyl or acrylic. The polymer should have a molecular weight of between 1,000,000 and 10,000,000 units, with about 5,000,000 to 7,000,000 units being preferred.

The ideal solution will be film-forming, free-flowing, resist evaporation, never solidify and remain stable for many years. The selection of the proper viscoelastic solution and the ideal fluid rheology, texture, flow and cohesiveness is important to the present invention.

It has been found that a viscoelastic fluid made from a butylene or isobutylene polymer enhanced hydrocarbon mineral oil at a concentration of about 0.1–2% is preferable. Oil based solvents are preferred over aqueous solvents since aqueous solvents tend to evaporate, become unstable, may solidify or undergo biological attack. Oil based fluids can remain stable indefinitely. A mineral oil base should have a very low order of toxicity, flammability and odor. The solvents should also be safe and essentially non-toxic so that they do not present a hazard to those using the device.

The mechanical manipulation of the viscoelastic liquid should be presented in an entertaining fashion. It is preferred that the display be portable, but it may be fixed for some purposes. By totally enclosing the display, the chance of fluid spillage and undesired touching is eliminated. Open displays can, however, be used in some situations where sufficient control of observers can be maintained.

Figure 1:
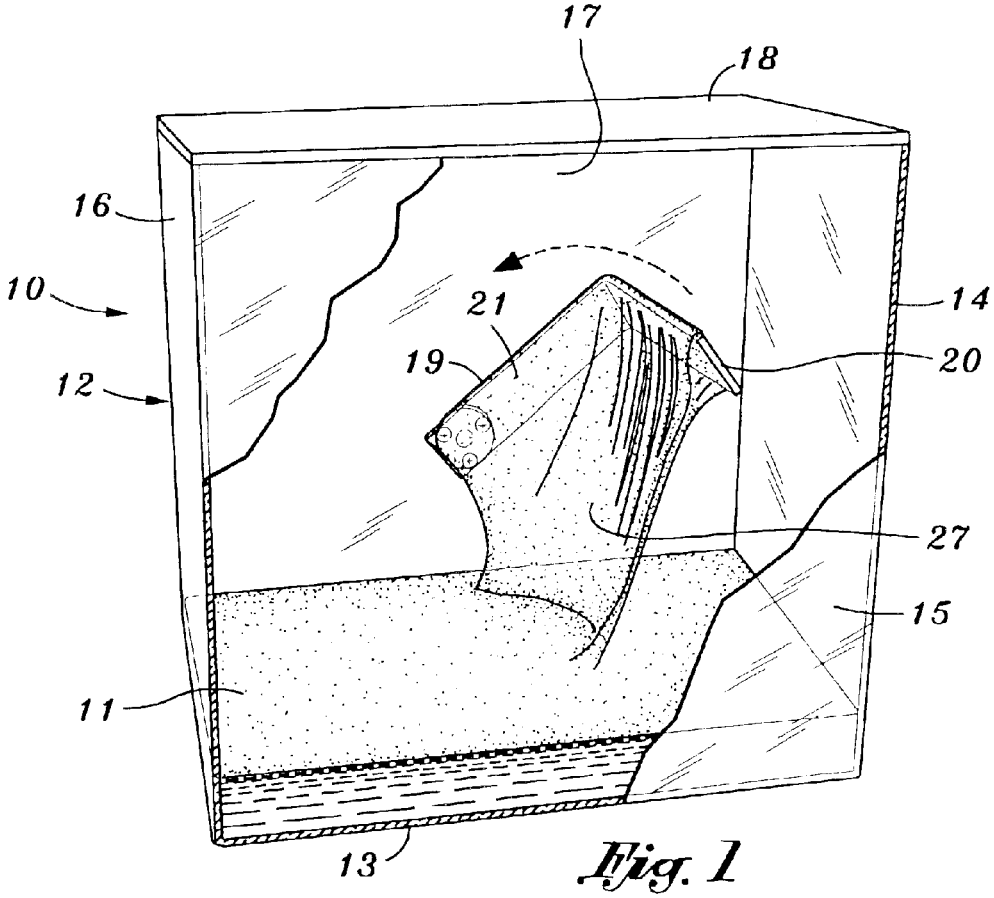
FIG. 1 is a perspective view partially cut away of the display apparatus of the present invention.

Turning now to the drawings, a mechanical display apparatus is shown in perspective view in FIG. 1 partially cut away and indicated by reference character 10. The apparatus has a container which holds a volume of a viscoelastic solution 11, the properties of which are described above. Container 12 has a bottom 13, sidewalls 14, 15, and 16, and a back wall 17. A top 18 completely encloses the container 12.

Figure 2:
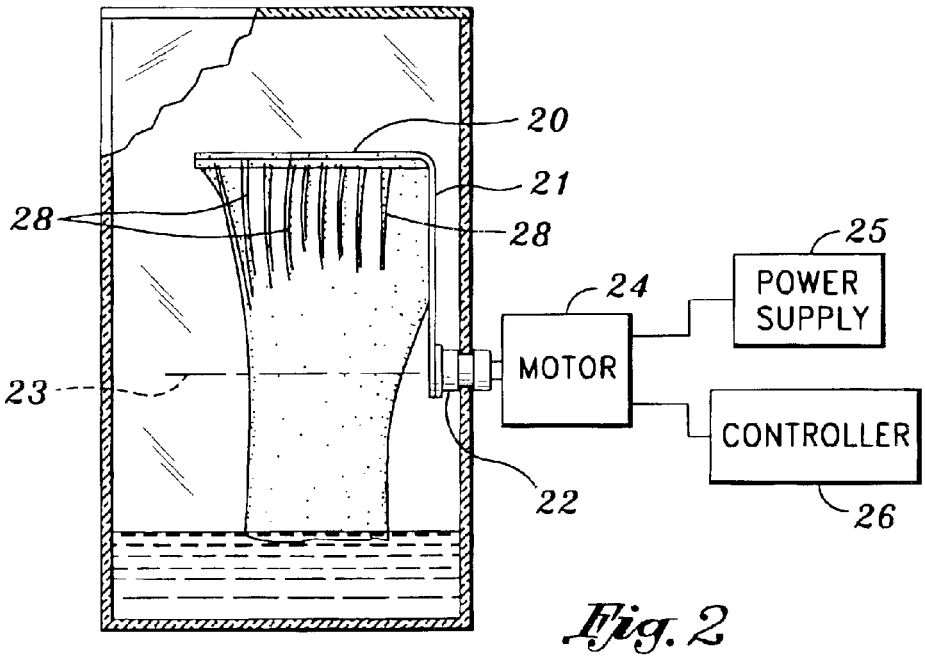
FIG. 2 is an end view partly in cross-section of the device of FIG. 1, including a schematic representation of a drive means for the moving portion thereof.

An L-shaped draw bar 19 is held to back 17 as shown best in FIG. 2. Draw bar 19 has a horizontal arm 20 and a vertical arm 21. Vertical arm 21 is affixed to an-output shaft 22, which has an axis of rotation 23. Output shaft 22 is driven by motor 24 which has a power supply 25 and a controller 26.

Motor 24 preferably rotates slowly, preferably between one and five revolutions per minute, with about two revolutions per minute being preferred.

As the L-shaped draw bar 19 slowly rotates as indicated in FIG. 1, it picks up a smooth liquid sheet 27 of viscoelastic material, which slowly sheds from both the horizontal arm 20 and also from the vertical arm 21. As it sheds, it forms a number of ribs which change in size and shape as it flows from the horizontal bar 20.

The object which is drawn from the viscoelastic solution may be any size or shape, but bars, paddles, spatulas, wheels, gears, spindles, balls, fingers, a hand or any other suitable object may be used. A flat L-shaped bar provides an especially interesting display because of the ability of the flat portion of the bar to support a relatively large amount of viscoelastic solution. As the fluid coated arm begins its upward arc exiting the fluid reservoir, the fluid is stretched into a uniformly smooth liquid sheet across the horizontal length of the bar, slowing shedding but remaining intact as a sheet. As the bar continues to rotate past the apex of the arc, the liquid sheet begins to reduce in size as the liquid reenters the reservoir of viscoelastic solution 11.

Several variations to a single utensil dipping into and stretching the viscoelastic fluid are contemplated. Multiple motorized utensils may be used and an array of one or more motors or gears or pulleys can be used to dip objects in and out of the fluid at different times or speeds. Such utensils may be moved in harmony or disharmony, centered, offset, traversing or converging with the result of enhancing the visual perspective of the device. The motors may be reversing motors, or may move in a vertical and horizontal direction. Linear or non-linear arrays that stretch, twist or tie the fluid into knots is another possible effect. A track-driven utensil or multiple utensils dipping in and out of the fluid which travel through a maze or a random path offers another way to manipulate the fluid.

The fluid can be colored, can contained glitter or pearl essence. An especially attractive effect results from adding an ultraviolet active dye to the fluid. Then a black light of the long wave ultraviolet spectrum is used to light the display.

The device is useful for conventions or trade shows where it is desired to attract people to an informative booth. It is relatively inexpensive to fabricate and operate and provides an ever-changing source of entertainment and relaxation.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A display device which provides an entertaining/relaxing visual display showing the formation of a stretched and moved sheet of a viscoelastic solution comprising:

a bottom chamber capable of containing a volume of a viscoelastic solution, said bottom chamber having a bottom floor and side walls and having an open area above the bottom floor;

a volume of a fluid comprising a viscoelastic solution held in said bottom chamber, said viscoclastic solution having an upper surface; and a solid drawing element movable from a position above the upper surface of the viscoelastic solution to a position wherein at least a portion of the solid drawing element can enter the upper surface of the viscoelastic solution and can enter the volume of the viscoelastic solution and can be moved to a position wherein at least a portion of the solid drawing element can be drawn upwardly from said upper surface of the viscoelastic solution supporting a held volume of viscoelastic solution, said viscoelastic solution being raised by the drawing element without the necessity of an enclosed liquid raising container, and can be moved to a position where it is capable of being maintained above the upper surface for a time sufficient for a portion of said held volume to drain from said solid drawing element thereby forming a moving sheet of viscoelastic solution between the drawing element and the upper surface of the viscoelastic solution to create an interesting visual effect and said lifting element permitting the draining of the viscoelastic solution as soon as it raises above the upper surface of the viscoelastic solution.

2. The display device of claim 1 wherein the viscoelastic solution is a solution of a polymer selected from the group consisting essentially of those derived from cellulose, acrylic, alginate, ethylene, propylene, butylene, vinyl, latex, lipids, carbohydrates and proteins.

3. The display device of claim 2 wherein said polymer is a polymer polymerized from monomers selected from the group consisting essentially of ethylene, propylene, butylene, vinyl and acrylic monomers.

4. The display device of claim 3 wherein said polymer has a molecular weight between 1,000,000 and 10,000,000.

5. The display device of claim 4 wherein said polymer has a molecular weight between 5,000,000 and 7,000,000.

6. The display device of claim 2 wherein said polymer is dissolved in an oil based liquid.

7. The display device of claim 6 wherein said oil based liquid is mineral oil.

8. The display device of claim 1 wherein said viscoelastic solution is a solution is at least about 0.1% and no more than 2% solution of a polymer selected from the group consisting of butylene polymer and isobutylene polymer in mineral oil.

9. A method for providing an interesting visual display comprising:

placing a volume of a viscoelastic solution in the bottom of a container;

movably supporting a drawing element on a movable support which may be moved so that the drawing element dips into and out of said volume of viscoelastic solution, said drawing element being free of any liquid raising container;

moving said movable support so that the drawing element dips into said viscoelastic solution;

slowly moving said movable support so that at least a portion of said drawing element lifts out of said viscoelastic solution thereby lifting a portion of the viscoelastic solution on the portion of the drawing element lifted out of the viscoelastic solution without the use of a liquid raising container and causing it to slowly fall back into the viscoelastic solution from the moment it is drawn from the viscoelastic solution thereby causing an interesting effect.

10. The method of claim 9 wherein said movable supporting step comprises:

rotatably supporting said drawing element about an axis of rotation above said volume of viscoelastic solution but close enough so that as the drawing element is rotated about said axis of rotation, a portion of the drawing element will pass into and out of said viscoelastic solution; and slowly rotating said drawing element.

11. The method of claim 10 wherein said drawing element is rotated by an electric motor.

12. The method of claim 11 wherein said motor is rotated at a speed of between one and five revolutions per minute.

13. The method of claim 12 wherein said drawing element is an L-shaped bar having a vertical portion and a horizontal arm.

14. The method of claim 13 wherein said motor is rotated at about two revolutions per minute.

* * * * *